United States Patent [19]

Sell

[11] Patent Number: 4,667,175

[45] Date of Patent: May 19, 1987

[54] OVERLOAD PROTECTIVE CIRCUIT BREAKER

[75] Inventor: William F. Sell, Altdorf, Fed. Rep. of Germany

[73] Assignee: Ellenberg & Poensgen GmbH, Altdorf, Fed. Rep. of Germany

[21] Appl. No.: 888,387

[22] Filed: Jul. 23, 1986

[30] Foreign Application Priority Data

Jul. 26, 1985 [DE] Fed. Rep. of Germany ..... 3526785

[51] Int. Cl.[4] ..... H01H 71/16

[52] U.S. Cl. ..... 337/68; 337/347

[58] Field of Search ..... 337/66, 68, 91, 82, 337/347, 368

[56] References Cited

U.S. PATENT DOCUMENTS

| | | | |
|---|---|---|---|
| 2,487,683 | 11/1949 | Wilson | 200/138 |
| 3,569,888 | 3/1971 | Taylor | 337/89 |
| 3,753,195 | 8/1973 | Woods | 337/347 |
| 4,365,228 | 12/1982 | Rowley | 337/347 |
| 4,510,481 | 4/1985 | Ubukata et al. | 337/347 X |
| 4,573,031 | 2/1986 | Krasser | 337/68 |

FOREIGN PATENT DOCUMENTS

| | | |
|---|---|---|
| 2646840 | 4/1978 | Fed. Rep. of Germany . |
| 3526785 | 7/1986 | Fed. Rep. of Germany . |

*Primary Examiner*—A. D. Pellinen

*Assistant Examiner*—Derek S. Jennings

*Attorney, Agent, or Firm*—Spencer & Frank

[57] ABSTRACT

A preferably push button-actuated overload protective circuit breaker with bimetal cut-out is devised for being plugged into a flat female plug socket. The circuit breaker comprises a bimetal contact element and a fixed contact element besides each other and consisting each of an elongated punched-out part of substantially flat right parallelepiped shape. They have outer ends protruding out of a circuit breaker housing and lying with their flat longitudinal sections in the same plane, while their inner free ends inside the housing have their flat longitudinal sections lying in two different planes which are parallel with, but spaced from each other. A bimetal snap element is fastened at one end thereof, on the inner free end of the bimetal contact element and overlaps with its opposite slewable end, which bears a bimetal contact post, the inner free end of the fixed contact element and a fixed contact post thereon. In their middle regions, the bimetal and fixed contact elements are embedded positively in a form-stable base member made of injectable or castable synthetic electrically insulating material, which base member forms a part of the walls of the housing. At the region where the bimetal contact element protrudes from the base element to extend into the interior of the housing, it bears a weakened zone, e.g. a puched-out hole, as a bending zone being adjustable to a desired bend.

13 Claims, 6 Drawing Figures

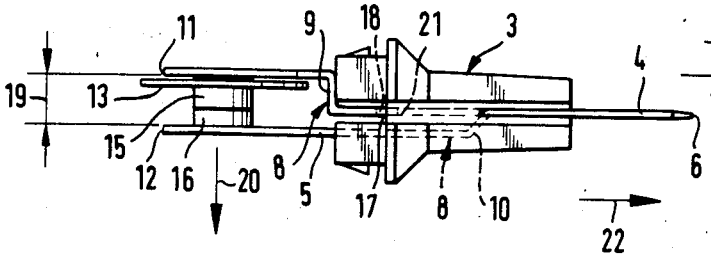
Fig. 2
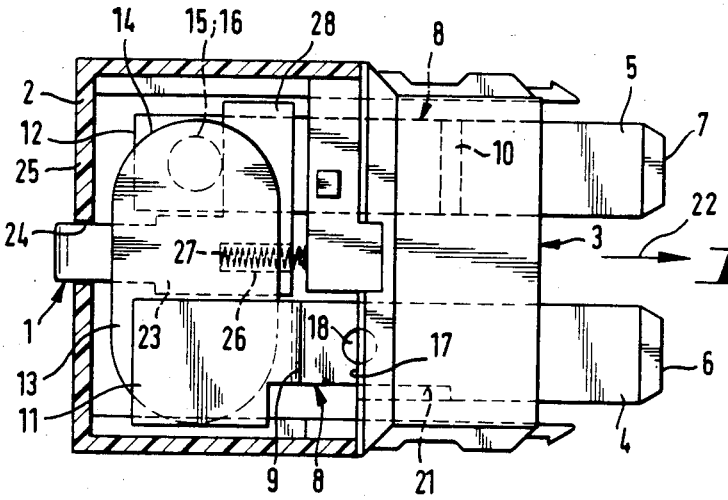
Fig. 1
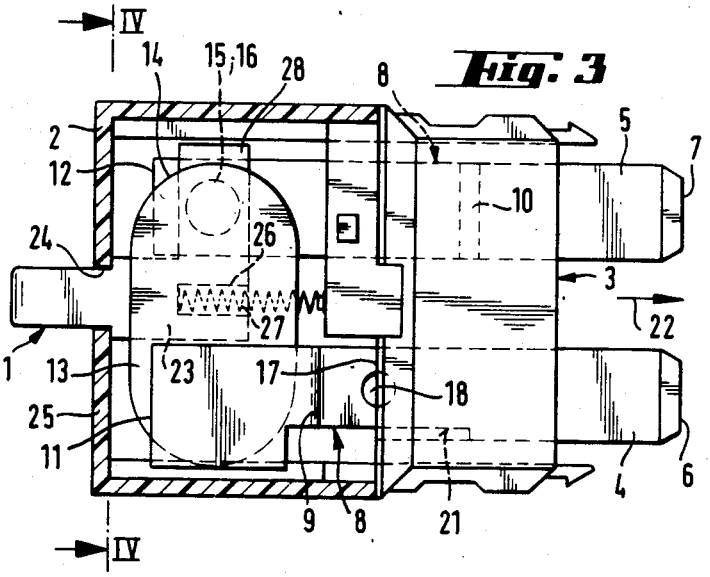
Fig. 3
Fig. 4
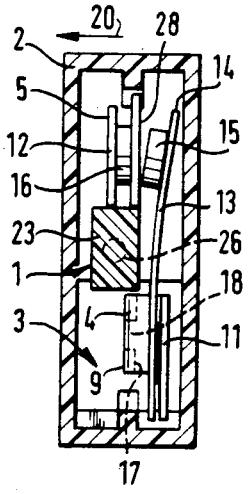

OVERLOAD PROTECTIVE CIRCUIT BREAKER

BACKGROUND OF THE INVENTION

This invention relates to an improved overload protecive circuit breaker with bimetal cutoff, adapted for being plugged into a flat-shape fuse female plug socket, which circuit breaker comprises a housing and, in the hollow interior thereof, a fixed contact element and a bimetal contact element, extending besides each other affixed in a sidewall of the housing, and each being an elongated punched-out part of flat rectangular cross sectional area;

a bimetal snap element fastened on the free end of the bimetal contact element, which snap element extends transversely to the longitudinal axis of the contact elements between their free ends in the interior of the housing;

the bimetal snap element having a contact end and overlapping a fixed contact arranged at the free end of the fixed contact element, and being held with its contact end in contact with bias against the fixed contact.

Such circuit breakers which are push button-actuated are known from the U.S Pat. No. 4,573,031 to Fritz Krasser (corresponding to German Offenlegungsschrift DE 33 42 144 A1 published on May 30, 1985). They are of very small dimensions and can therefore be used as substitutes for flat-shape fusible cutouts. They consist essentially of a housing between the sidewalls of which two contact elements are held in position. One of these two contact eIements is a bimetal contact element and the other one a fixed contact element; they are arranged alongside each other and designed each as an elongated, punched-out part having approximately the shape of a flat right parallelepiped. The external end portions of the two contact elements of the known circuit breaker, i.e those ends thereof which protrude from the housing, have main longitudinal sections extending both in a common plane, while the opposite, inner free ends of the contact elements, i e. those ends thereof which are located in the interior of the housing, have their main longitudinal sections extend in two different, parallel planes, but laterally spaced from each other (By main longitudinal section of a contact element there is meant the section, extending through that central longitudinal axis of the element, which extends parallel with the broader long faces of the elongated right parallelepiped constituting the element).

Due to this lateral displacement, in addition to the vertical spacing of the two contact elements due to their extending in the two parallel planes, it is made possible for the bimetal snap element, which is arranged between these contact elements, to be located approximately in the main central axial plane of the bimetal contact element and at the same time to overlap the fixed contact element. The snap movement of the snap element can thus take place toward either side from the main extension plane of the bimetal contact element At the inner free end of the bimetal contact element in the known circuit breaker the bimetal snap element is fastened on one face by a mounting end. The snap element extends transversely to the direction in which the contact elements are moved when being plugged into a female plug socket, and overlaps with its slewable free end opposite its mounting end the inner free end of the fixed contact element. In its rest position, i.e. when it is not heated, the bimetal snap element rests, with a bimetal contact mounted on the slewable free end, with bias on the fixed contact post at the inner end of the fixed contact element It is a drawback of the known overload protective circuit breakers of this type that the two contact elements extend through the separating joint, between the two shell halves constituting the circuit breaker housing, in approximately the same plane. In doing so, the contact elements rest in special molded recesses of the housing shell halves and are fixed therein, for instance, by means of a pin-and-bore connection. The rigidity of this connection is, however, not very great and does not stabilize sufficiently the positions of the two contact elements relative to one another. In view of the relatively high manufacturing tolerances and the two-part design of the housing, a mutual displacement of the contact elements is relatively easy to happen. Thereby, the cutoff characteristics of an overload protective circuit breaker of this type can be strongly influenced. In practice, this means a high rate of waste in manufacturing, and a relatively broad spread of the cutout time.

OBJECTS AND SUMMARY OF THE INVENTION

It is an object of the invention to provide a circuit breaker of the initially described kind which, after having been assembled from its various parts, is adapted for easy adjustment of its essential functional parts, and which is so devised as to keep the cutoff characteristics thereof within narrow ranges of tolerance.

This object and others that will become apparent from the further description of the invention, are attained, in accordance with the invention by the novel features of providing the circuit breaker of the above-described kind with a contact elements-supporting base member of permanent shape, made of injection-moldable or castable synthetic resin insulating material in which base member the central regions of both the bimetal contact element and the fixed contact element are embedded in a positive, form-locked manner, and the bimetal contact element comprises, in the rearward region thereof emerging from the base member, a reduced strength zone being available as an adjustable bending zone.

This construction guarantees, on the one hand, that the bimetal contact element and the fixed contact element are both affixed immovably relative to each other. This is an important criterion for maintaining a specific cutoff characteristic during the entire working time of the circuit breaker. On the other hand, the bimetal contact element can be easily bent in its zone of reduced strength by means of a suitable adjusting device. Thereby, the distance between the bimetal contact and the fixed contact is changed and thereby also the bias urging the bimetal snap element against the fixed contact. It is thus possible to adjust subsequently the desired tolerance range of the cutoff characteristic of the circuit breaker according to the invention in a simple manner, and to maintain it safely during the entire time of operation. As the weakened zone of the bimetal contact element is located at the point where it emerges from the base member, there is available the largest possible lever arm for an adjusting displacement of the inner free end of the bimetal contact element. This adjustment can, therefore, be a very fine one. Last not least, the protective circuit breaker according to the invention is of particular mechanical stability.

This stability is further improved by embedding the two contact elements in the base member material each in its central region which amounts to about one third of the total length of each element Once it has been adjusted to a desired setting, the cutoff characteristic can practically not be changed anymore by normal stresses occurring during the use of the circuit breaker. Moreover, when the above-mentioned main longitudinal sections of the bimetal contact element and the fixed contact element extend in the interior of the housing parallel with, and spaced from, each other, and when they extend in one and the same plane outside the housing, preferably, these two elements have each a step-like bend extending transverse to the direction in which the contact elements are moved when plugging them into a female socket, which bends of the two contact elements are embedded in the material of the base member. It is moreover made impossible to move the fixed contact arm in the direction of its longitudinal axis vis-á-vis the base member. The same purpose is achieved when the bimetal contact element has in its middle region, which is embedded in the base member material, inwardly a stepshaped narrowed zone. Due to this narrowed zone the bimetal contact element is likewise secured immovably in axial direction in the base member material. The weakened zone in the bimetal contact element can be provided by a punched-out hole which extends about normal to the main central axial plane of this element. This enables producing the desired adjusting bend in the bimetal contact element at the same time when manufacturing the punched part itself, and avoids a twisting of the inner free end of the bimetal contact element about its longitudinal axis during the adjusting step.

By arranging the punched-out hole directly at the edge of the base member, the desired adjustable zone can be located even more exactly, and the result of the adjusting step is even more exactly reproduceable. The tendency of the bimetal contact element to bend by itself in the weakened zone, which is caused by the presence of the weakened zone per se, will be enhanced by the fact that exactly at the weakened zone there will be located the fulcrum if the inner free end of the bimetal contact element acts as a one-arm lever.

Embedding of the middle region of the bimetal contact element and thereby its stability is further improved by having the material of the base element penetrate into and partially fill the punched-out hole in the weakened bimetal element zone. This also prevents effectively a displacement of the bimetal contact element along its longitudinal axis vis-á-vis the base member.

By providing the weakened, reduced-strength zone of the bimetal contact element in a different manner, namely by a notch at least in one side margin of the middle region of this element, preferably however in both marginal edges for instance, by punching out halves of holes therefrom, it is rendered possible in a simple manner, not only to bend the bimetal contact element once vertically to its main central axial plane but additionally to twist it if this is necessary to achieve an appropriate adjustment. The circuit breaker according to the invention can be manufactured as a particularly space-saving article by providing for the base member to constitute at least a part of a wall of the breaker housing in the finished circuit breaker, and preferably the closing part of a one piece housing cap. In this embodiment, the circuit breaker according to the invention can also serve as a substitute for a simple flat fusible cutout. The base member thus takes over the additional function of a wall part of the circuit breaker housing.

BRIEF DESCRIPTION OF THE DRAWINGS

Further objects and advantages of the circuit breaker according to the invention will become apparent from the following description thereof in connection with the accompanying drawings illustrating a preferred embodiment thereof. In the drawings, FIG. 1 is a view from above of the interior of the embodiment of the circuit breaker, with the parts in circuit-making position;

FIG. 2 is a lateral view of the base member, shown from above in FIG. 1, together with the contact elements and the bimetal snap element in circuit-making position;

FIG. 3 is a view from above of the interior of the embodiment of FIG. 1, but with the parts in cutout position;

FIG. 4 is a cross-sectional view of the embodiment shown in FIG. 3 taken in a plane indicated by IV—IV in that Figure;

DETAILED DESCRIPTION OF THE EMBODIMENTS SHOWN IN THE DRAWINGS

Figures 5, 6:
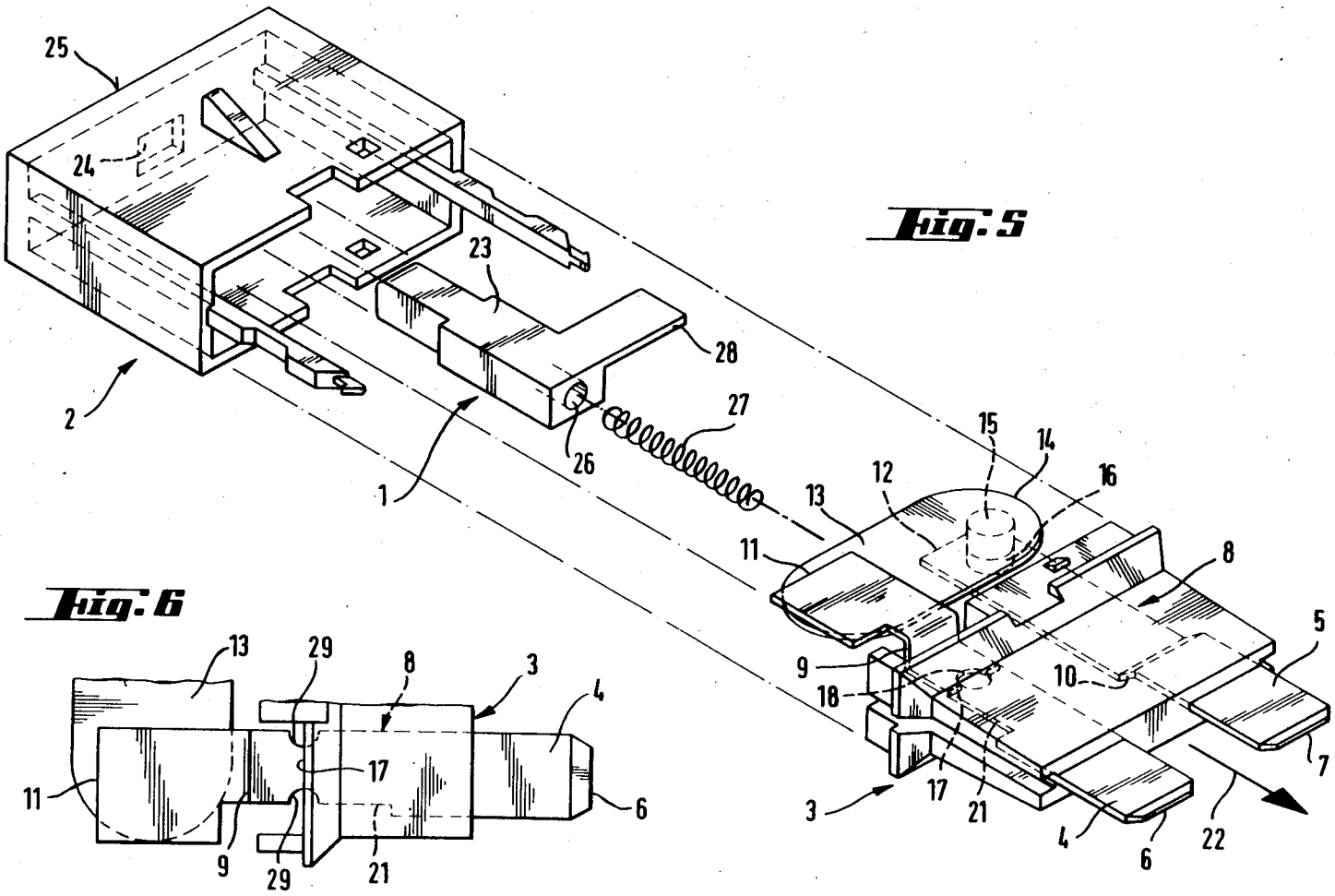
FIG. 5 is an exploded view in perspective of the parts constituting the embodiment shown in FIGS. 1 to 4.
FIG. 6 is a partial top view of the bimetal contact element shown in FIGS. 1 to 5, but with a modified embodiment of the weakened zone therein.

The overload protective circuit breaker which can be actuated by the push button 1 comprises a housing being composed of a cap 2 and a base member 3. Both parts are made of an electrically insulating material by injection molding or casting. In the base element which has approximately the shape of a right parallelepiped, there are embedded a bimetal contact element 4 and a fixed contact element 5. The two contact elements 4 and 5 consist each of an elongated punched-out metal piece having the shape of a flat right parallelepiped.

Main central axial, i.e. longitudinal, sections of the plug-in ends 6 and 7, respectively, of the contact elements 4 and 5 which ends protrude from the housing, extend in one and the same common plane. The contact elements 4 and 5 lie parallel besides each other and their ends 6 and 7 are designed as flat plug-in prongs. In its middle region 8 each of the contact elements 4 and 5 has a bend 9 or 10, respectively, one of them, namely the bend 9 of the bimetal contact element 4, being upward from the said common plane, and the other one, the bend 10 of the fixed contact element 5 being downward, as shown in FIG. 5. Hence, these bends 9 and 10 are directed to be turned aside inside the housing, but in opposite directions.

The main central axial sections of the inner free ends 11 and 12, respectively, of the contact elements 4 and 5 thus extend in two different planes which are parellel with each other, but spaced from each other by the distance 19 (Fig.2). The bend 9 of the bimetal contact element 4 is located in the interior space of the housing, inside the cap 2, while the bend 10 of the fixed contact element 5 has been embedded in the base member material during injection molding or casting of the base member.

A bimetal snap element 13 which, in the illustrated embodiment is approximately oval-shaped but can be disc-shaped or of any other suitable configuration, is fastened electrically conductively with its one end on the inner free end 11 of the bimetal contact element 4. This snap element 13 extends transversely to the direction in which the contact elements 4 and 5 extend, toward the fixed contact element 5, and overlaps with its opposite end 14 the inner free end 12 of the latter. Due to the bimetal connection by welding or soldering of the snap element 13, its end 14 is slewable and bears the bimetal contact post 15 which is thus movable in a direction toward or away from a fixed contact post 16 on the inner free end 12 of the fixed contact element 5. In its rest position the bimetal contact post 15 abuts with bias against the fixed contact post 16 and makes circuit.

A punched-out hole 18 is provided in the bimetal contact element 4, in the region 17 thereof where the element 5 protrudes from the base member 3 into the interior of the cap 2, which hole extends normal to the main axial section of the element 5 and, as shown in FIGS. 1 to 5, is a throughhole. This throughhole 18 creates a weakened transverse zone which can function as a zone of desired adjusting bending, whenever this should be required after the assembly of the contact elements and base member, before closing the housing by mounting the cap 2 on the base member 3.

In FIG. 6, there is shown a different mode of generating a weakened region in the bimetal contact element 4 namely by producing two notches 29, in opposite marginal portions of the element 4, e.g. by punching out half holes therefrom.

In that region of the bimetal contact element 4 which is surrounded by the material of the base member 3 there is provided a stepped narrowed region 21 by cutting a recess in one of the edges of the element 4 (FIG. 5) which narrowed region has exactly the same effect as the embedded bend 10 in the fixed contact element 5, in that it prevents any axial displacement of the contact element inside the embedding material of the base member 3.

As can be seen from FIGS. 1 and 3, the circular punchedout throughhole 18 is located exactly at the emergence point 17 of the bimetal contact element 4 from the base member 3. Thereby, the throughhole 18 is partly filled with base member material, which results in an additional arresting effect holding the bimetal contact element 4 fast in the base member 3, and also provides a well-defined fulcrum for the inner free end 11 of the element 4 when the angle of bending of that free end is to be adjusted to change the bias exerted on the fixed contact post.

In the interspace between the two inner free ends 11 and 12 of the contact elements 4 and 5, there is arranged a push button 1, for switching the circuit breaker to make circuit, by moving the button 1 in the direction 22 of plugging-in the prong ends 6 and 7 into a female plug-in socket. The push button is essentially L-shaped, with the free end of its L-leg 23 (shown horizontally in FIGS. 1 and 3) extending through an opening 24 in the end or top wall 25 of the cap 2 to the outside.

At the base edge of the L-leg 23, common with the edge of the other L-leg 28 there is provided a dead end bore or cavity 26 opening in the plugging direction 22, which cavity houses a pressure spring 27 The latter is supported on the upper (in FIGS. 1, 3 and 6, the vertical) end face of the base member 3, turned toward the interior of the housing, and urges the push button 1 in a direction opposite to the plugging-in direction 22. The L-leg 28 (extending vertically in FIGS. 1 and 3) of the push button 1 is thus pushed between the contact posts 15 and 16 and breaks circuit (FIGS. 3 and 4). When the push button 1 is pushed further into the housing and thereby out of its position between the posts 15 and 16 against the force of the spring 27 and arrested in this position (by conventional means not shown) the bimetal contact post 15 will make contact under its own bias with the fixed contact post 16 (FIG. 1), unless and until an excess current will heat the bimetal contact and cause the snap element 13 to bend, thus opening a gap between the posts 15 and 16 and breaking circuit.

I claim:

1. In an overload protective circuit breaker with bimetal cutoff and comprising in the hollow interior of a housing thereof (a) a fixed contact element and a bimetal contact element extending beside and spaced from each other being affixed in a sidewall of the housing and being each an elongated punched-out body of at least approximately the shape of a flat right parallelepiped having a central longitudinal axis and two opposite large faces and connecting them two small side faces, each of said elements having an inner free end, located inside said housing interior, and bearing a contact post on said free end, (b) a bimetal snap element being fastened with a first end thereof on the inner free end of said bimetal contact element and extending transverse to said longitudinal axes of said contact elements, another end of said bimetal snap element, opposite said first end thereof, overlapping the inner free end of said fixed contact element, said contact post on said bimetal contact element abutting said contact post on said fixed contact element with bias when said bimetal contact element and bimetal snap element thereon are in unheated rest position, the improvement comprising (1) a base member, said base member having embedding therein the middle regions of said bimetal and fixed contact elements, said base member being made of a formstable synthetic electrically insulating material, and (2) a reduced-strength zone in said bimetal contact element where the same protrudes from said base member into said housing interior, said reduced-strength zone being adapted for adjusting bending of said inner free end of said bimetal contact element in said housing relative to the parts of said metal contact element embedded in said base member.

2. The improvement of claim 1, wherein those middle regions of said contact elements embedded in said base member amount to about one third of the total lengths of the respective contact elements.

3. The improvement of claim 1, wherein those portions of said contact elements in said housing interior have sections, through their central longitudinal axes and parallel with their large faces, extend in planes which are parallel with, but spaced from, each other, wherein those portions of said contact elements located outside said housing have their corresponding sections extend in one and the same common plane, and wherein said fixed contact element has a step-like bend in said middle region thereof and extending transverse to said longitudinal axis thereof, embedded in said base member.

4. The improvement of claim 1, wherein said middle region of said bimetal contact element embedded in said base member material comprises a step-shaped recess in at least one of said smaller side faces thereof, leaving a narrowed diameter zone in said middle region.

5. The improvement of claim 1, wherein said reduced-strength zone of said bimetal contact element comprises at least one hole extending approximately normal to a plane passing through said longitudinal axis of said bimetal contact element and parallel with said large faces thereof.

6. The improvement of claim 5, wherein said hole is a punched-out throughhole.

7. The improvement of claim 5, wherein the hole is arranged directly at said base member on the side thereof facing into said housing interior.

8. The improvement of claim 7, wherein material constituting said base member partly fills said hole in said bimetal contact element.

9. The improvement of claim 1, wherein said reduced-strength zone comprises at least one notch in at least one of said small side faces of said bimetal contact element.

10. The improvement of claim 9, wherein at least two of said notches are present in said bimetal contact element one in each of the two small side faces thereof, in said reduced-strength zone.

11. The improvement of claim 1, wherein said base member is a part of said housing enclosing said interior thereof.

12. The improvement of claim 11, wherein said housing comprises a single piece cap and said base member as the only two parts thereof, said cap fitting on said base member containing said two inner free ends of said contact elements and said bimetal snap element, to close said housing and enclose said last-mentioned three parts borne by said base member therein, thereby completely assembling said circuit breaker.

13. The improvement of claim 1, wherein said bimetal snap element is approximately oval-shaped.

* * * * *